United States Patent [19]

Best

[11] Patent Number: 4,664,029

[45] Date of Patent: May 12, 1987

[54] FOOT ACTUATED SCREEN PRINTING APPARATUS

[76] Inventor: Kermit D. Best, Box 227-A, Bailey, N.C. 27807

[21] Appl. No.: 395,495

[22] Filed: Jul. 6, 1982

[51] Int. Cl.[4] ..... B41F 15/30; B41F 15/38

[52] U.S. Cl. ..... 101/35; 101/126

[58] Field of Search ..... 101/123, 126, 35, 114, 101/115, 124, 9, 10; 2/195, 199; 223/24, 25, 26

[56] References Cited

U.S. PATENT DOCUMENTS

| | | | |
|---|---|---|---|
| 370,947 | 10/1887 | Jones | 101/126 |
| 540,446 | 6/1895 | Howe | 223/25 |
| 781,592 | 1/1905 | Catino | 223/24 X |
| 1,939,965 | 12/1933 | Flockhart | 101/123 |
| 2,315,730 | 4/1943 | Orthwine | 101/126 |
| 3,486,441 | 12/1969 | Hillman et al. | 101/123 X |
| 4,266,476 | 5/1981 | Maloof | 101/114 X |

*Primary Examiner*—Charles A. Pearson
*Attorney, Agent, or Firm*—Mills & Coats

[57] ABSTRACT

The present invention entails a relatively simple foot actuated screen printing apparatus for printing designs, insignias or the like on apparel and which is particularly adapted for the printing of caps. The printing apparatus of the present invention includes an article holder that in the design disclosed herein includes an arcuate shaped plate for receiving the article to be printed and a screen frame assembly movably mounted thereover. Screen frame assembly is supported by a pair of upright stationary members and is movable upwardly and downwardly relative thereto. A foot actuated pedal is operatively interconnected to said screen frame assembly for moving the same from an upper in operative position to a lower operative printing position where a screen carried by said screen frame assembly directly overlies and engages the article to be printed. A spring is provided and is operative to move the screen frame assembly and the screen carried thereby from the operative printing position to the upper elevated inoperative position in response to the foot pedal being released.

5 Claims, 2 Drawing Figures

FOOT ACTUATED SCREEN PRINTING APPARATUS

FIELD OF INVENTION

The present invention relates to printing apparatuses and more particularly to screen type printing devices.

BACKGROUND OF INVENTION

In recent years a substantial market has developed for T-shirts, caps, jackets, etc., that are provided with printed matter. Such printed matter on these types of apparel include advertisements as well as work of art or simply slogan and writings of a nonadvertising nature.

A very significant amount of such printing is accomplished through what is known as screen printing. Simply stated, a screen is designed and prepared to yield a certain design, insignia, symbol or the like. Such a screen is designed to be accepted by a printing machine and once installed, is lowered onto the article to be printed such that the screen lies adjacent to and over the area to be printed. A squeegee including an ink solution is then moved over the screen and the ink solution is allowed to sift or move through selected areas of the screen to yield a desired design on the underlying apparel. It follows that multi-colored designs can be accomplished by using a series of screens along with a series of different colored ink solutions.

There are a number of very distinct advantages to screen printing. First, it is relative simple and can be generally accomplished without a great deal of trouble at a reasonable expense. In addition screens can be relatively easily designed at a cost that does not require a large volume of printing in order to justify such.

There is, however, a number of serious drawbacks with respect to screen printing. In this regard, for the most part, screen printing devices and apparatuses have tended to be too sophisticated, complex and expensive. A review of the prior art in this area will reveal screen type printers of the nature disclosed in the following U.S. Pat. Nos. 2,894,451; 4,054,091; 4,266,476; 4,073,232; and 4,084,504. A review of these patents will reveal that screen type printing apparatuses have in fact all too often been too sophisticated and expensive, especially in terms of their capacity. The net result of this is that potential screen printers have not been able to justify an investment in such sophisticated and expensive screen printing machinery.

In addition there is a sizable market in screen printed caps. Often the upper front face portion of caps are commonly used for advertising purposes. Often such caps are printed on machines that are not totally designed for caps per se. The end result of this is that these machines have to be specially altered or the printing process is substantially slowed because of the time involved in appropriately placing and adjusting the cap for proper printing.

SUMMARY AND OBJECTS OF INVENTION

The present invention is aimed at presenting a relatively simple and inexpensive screen type printing apparatus that is very effective and efficient and which in the embodiment set forth herein is designed to easily and conveniently accept caps for printing.

The screen type printing apparatus of the present invention is foot actuated and includes a screen frame assembly movably mounted and actuated by a foot pedal.

The screen frame assembly is designed to accept a printing screen and once appropriately installed, the printing screen is brought into engagement with an article such as a cap on an article holding stand by pressing the foot pedal with one's foot. The screen frame assembly is biased to an inoperative position and will assume such a position by simply releasing the foot from the foot pedal. Another important part of the present invention resides in the provision of a screen frame assembly and the structure for supporting the same such that the same can easily and conveniently move upwardly and downwardly with respect to the article holding means. As will be understood from subsequent portions of this disclosure, this is provided by a stationary support and a movable bushing design that is simple but yet very effective.

It is, therefore, an object of the present invention to provide a relatively simple and inexpensive screen printing apparatus.

A further object of the present invention resides in the provision of a screen printing apparatus of the character referred to above but which is both effective and efficient.

Another object of the present invention resides in the provision of a screen printing apparatus that is foot actuated, thereby enabling one operator to operate the same with both hands being free to handle the article being printed and to carry out the printing operation.

Another object of the present invention resides in the provision of a foot actuated screen printing apparatus of the character referred to above that is sturdy, reliable and requires a minimum of maintenance.

Another object of the present invention resides in the provision of a screen printing apparatus that is easy to use and operate.

It is also an object of the present invention to provide a screen printing apparatus of the character referred to above that is specifically designed to print caps.

Other objects and advantages of the present invention will become apparent from a study of the following description and the accompanying drawings which are merely illustrative of the present invention.

DESCRIPTION OF PREFERRED EMBODIMENT

Figure 1:
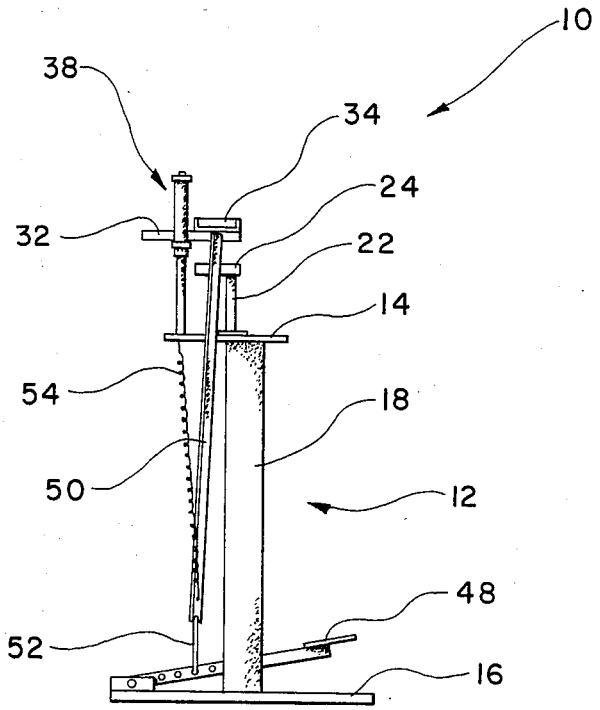
FIG. 1 is a side elevational view of the foot actuated screen printing apparatus of the present invention.

With further reference to the drawings, the foot actuated screen printing apparatus of the present invention is shown therein and indicated generally by the numeral 10.

Viewing screen printing apparatus 10 in more detail, it is seen that the same includes a main frame structure, indicated generally by the numeral 12. Main frame structure 12 includes a base support structure 14, a floor frame 16 and a vertical frame structure 18 extending between floor frame 16 and base support structure 14.

Figure 2:
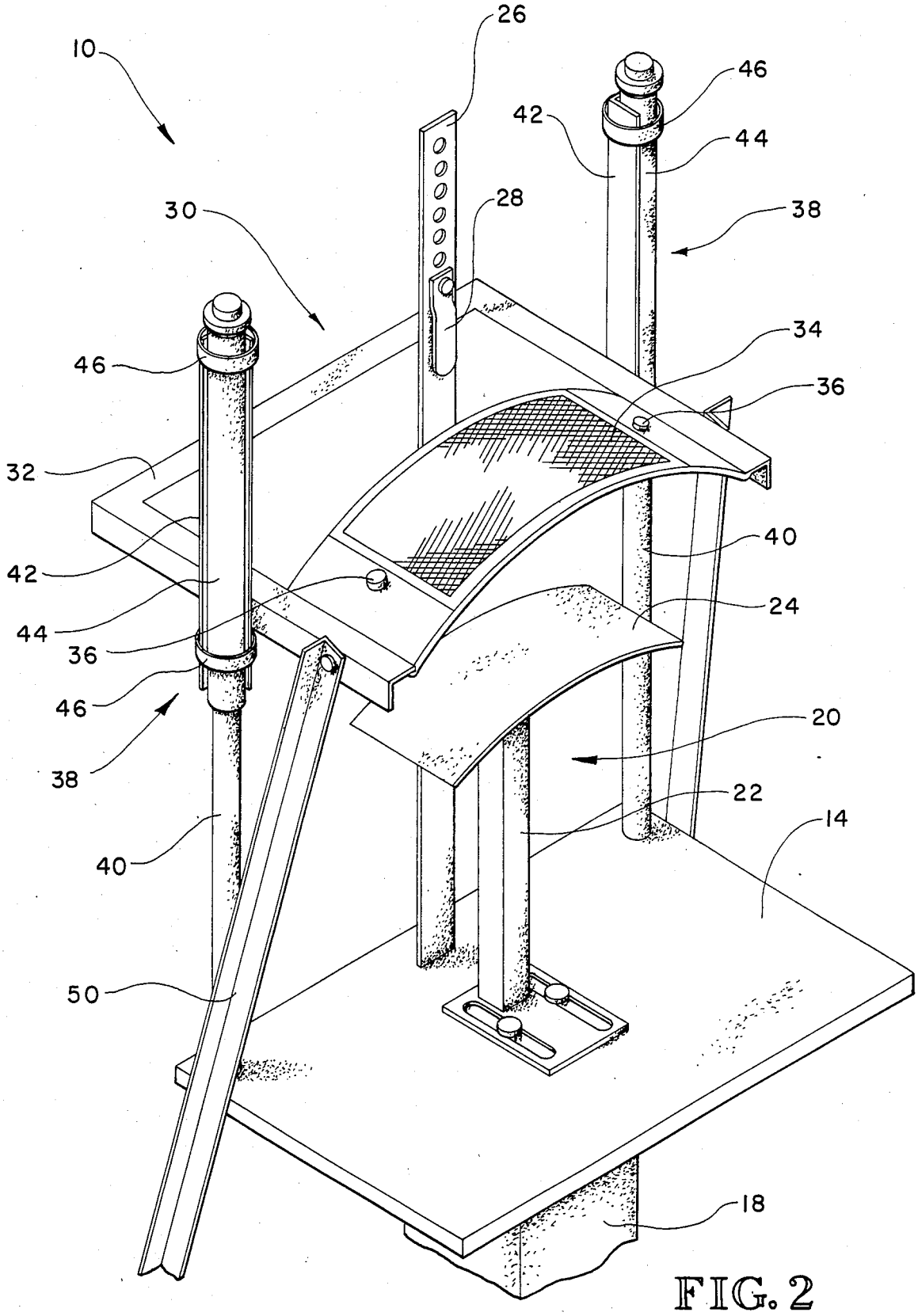
FIG. 2 is a fragmentary perspective view of the top portion of the foot actuated spring type press apparatus of the present invention.

Disposed on base support structure 14 is an article holding device indicated generally by the numeral 20. Article holding device 20 includes a vertical support 22 that is secured to base support structure 14 and as shown in FIG. 2 is adjustable back and forth thereon.

Secured to the top of vertical support 22 is an arcuate shaped top plate 24. It is seen that top plate 24 assumes a generally inverted U-shape. In the case of the embodiment illustrated herein, article holding device 20 is specifically designed to receive and support a cap during a printing operation thereon. Top plate 24 is particularly shaped to underlie the front half of a cap.

To provide additional support, there is provided a cap brim holding device. As particularly illustrated in FIG. 2, this cap brim holding device includes an elongated member 26 that extends upwardly from base support structure 14 just behind article holding device 20. Secured at an appropriate height on elongated member 26 is a brim holding clip 28 that would be constructed of spring steel or the like. Consequently, it is appreciated that once a cap is appropriately positioned over top plate 24 of holding device 20 that the brim portion thereof can be inserted between clip 28 and elongated member 26.

Movably mounted over base support structure 14 is a screen frame assembly, indicated generally by the numeral 30. Screen frame assembly includes a carrier frame 32 that is designed to accept a conventional printing screen 34. In this regard screen frame assembly 30 would include detachable securing means 36 such as bolts or the like, which enable a respective screen to be secured within carrier frame 32.

There is further provided mounting means, indicated generally by the numeral 38, for movably mounting screen frame assembly 30 for up and down movement relative to article holding device 20. Viewing mounting means 38 on opposite sides of base support structure 14, there is provided a stationary upright member 40. Extending along and adjacent each stationary upright member 40 is a movable member 42 that is attached to screen frame assembly 30. Interposed between stationary upright member 40 and movable member 42 is a slidable bushing 44. Further there is provided clamp means 46 that extends around bushing 44 and further around movable member 42. Thus it is appreciated that bushing 44 can move axially up and down stationary upright members 40 and because of the presence of the clamp means 46, the movable members 42 move therewith.

The movement of screen frame assembly 30 is accomplished through a foot actuated pedal 48, as seen in FIG. 1. There is provided linkage means operatively interconnecting screen frame assembly 30 with pedal 48. The linkage means includes a pair of links 50, the link being secured about opposite sides of said screen frame assembly 30 and extending downwardly therefrom. There may also be provided at the lower ends of links 50 a cross member (not shown) that extends therebetween. Operatively interconnected between links 50 and foot pedal 48 is a flexible connector such as cable 52.

A spring 54 is operatively interconnected between the linkage means and the main frame structure 12 of the foot actuated screen printing apparatus. Spring 54 biases screen frame assembly 30 to a first upper inoperative position.

In operation a screen 34 is designed to print a selected design, insignia or the like on an article such as a cap. The cap can then be folded such that the back half thereof lies inwardly adjacent the front half side, generally forming a half-moon shape. This half-moon shape is then placed over top plate 24 such that the front face of the cap faces screen 34 secured within carrier frame 32. In addition, the brim of the cap can be secured and held in place by the brim holder clip 28.

Next, with the operator's hand being free, the operator can engage foot pedal 48 with one of his feet and upon depressing the same will cause the screen frame assembly 30 to be moved downwardly towards article holding device 20. The pedal 48 is continued to be pressed until screen 34 lies directly over the front face of the cap. At this point with a squeegee, the operator can effectively print the insignia or design onto the cap.

At this point the operator can release foot pedal 48 and through the biasing action of spring 54 the screen frame assembly 30 and screen 34 thereof moves upwardly from article holding device 20 to its first upper inoperative position. The printed cap is then removed from the article holding device 20 and another cap is inserted thereon. The process is then continued.

From the foregoing discussion and specification, it is appreciated that the foot actuated screen printing apparatus of the present invention is relatively simple and inexpensive. The screen printing apparatus, however, is very effective and efficient. Because of its simple design the apparatus can be operated by a single individual who can actually carry out the entire printing process without any aid or assistance.

Although the present invention has been described in the context of a screen type printing apparatus design for printing caps, it is appreciated that principles of the present invention and particulary design principles of the screen printing apparatus may be utilized in other screen printing designs for other articles.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A foot actuated portable screen printing apparatus for printing and applying an insignia or design on an article such as a cap, comprising in combination:

A. a main frame structure including a base support structure, a floor support frame and a vertical frame structure extending between said floor support frame and said base support structure for supporting said base support structure at a level above the floor support frame;

B. article holding means secured to said base support structure for receiving and holding an article to be operated upon by said screen printing apparatus;

C. a screen frame assembly movably mounted above said article holding means and movable between a first upper position spaced from said article holding means to a second lower operative printing position adjacent said article holding means, said screen frame assembly including a carrier frame including a screen receiving area and provided with securing means for detachably securing a printing screen thereto;

D. mounting means for movably mounting said screen frame assembly and carrier frame thereof to said main frame structure including a pair of spaced apart stationary upright members extending upwardly from said base support structure, a pair of movable members secured to said screen frame assembly and extending adjacent respective stationary upright members and connecting means operatively interconnecting said stationary upright members to the respective movable members for allowing said movable members to move upwardly and downwardly along said stationary upright members in such a manner that said screen frame assembly is maintained in alignment with said article holding means, said connecting means operatively interconnecting said stationary upright members to respective movable members including bushing means movable up and down on respective stationary upright members and clamping means securing said movable members to said bushing means such that as said screen frame assembly is moved up and down said bushing means and movable members connected to said screen frame assembly move accordingly up and down along said stationary upright members;

E. a foot pedal assembly operatively connected to said screen frame assembly for moving the same from said first position to said second operative printing position including a movably mounted foot pedal and linkage means directly interconnected between said screen frame assembly and said foot pedal assembly that provides for the movement of said screen frame assembly in response to actuation of said foot pedal assembly; and wherein said linkage means includes a pair of laterally spaced rigid links disposed about opposite sides of said screen frame assembly and connected directly to said screen carrier frame and extending downwardly therefrom past said base support structure where said rigid links are directly connected to said foot pedal assembly; and F. biasing means associated with said screen printing apparatus for normally biasing said screen frame assembly to said first position spaced from said article holding means.

2. The foot actuated screen type printing apparatus of claim 1 wherein said article holding means is particularly adapted to receive caps and includes an upper support structure extending upwardly from said base support and a generally arcuate shaped upper plate secured about the top of said upwardly extending support and wherein said arcuate plate is curved upwardly from opposite sides so as to assume a generally inverted U shape.

3. The foot actuated screen type printing apparatus of claim 1 wherein said biasing means includes a spring operatively interconnected between said base support structure and said linkage means interconnecting said screen frame assembly and said foot pedal.

4. The foot actuated screen type printing apparatus of claim 3 including a brim holder extending upwardly adjacent said article holding means for receiving the brim of a hat supported on said article holding means in order to generally stabilize the hat during the printing operation.

5. The foot actuated screen type printing apparatus of claim 4 wherein said brim holder includes an elongated member extending upwardly adjacent said article holding means and including a spring steel holding member secured thereto for receiving the brim of a hat to be printed.

* * * * *